US007315229B2

(12) United States Patent
Sasaki et al.

(10) Patent No.: US 7,315,229 B2
(45) Date of Patent: Jan. 1, 2008

(54) ELECTROMAGNETIC RELAY

(75) Inventors: Tomoaki Sasaki, Kadoma (JP); Naoki Kanemoto, Kadoma (JP); Takafumi Imai, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/312,561

(22) Filed: Dec. 21, 2005

(65) Prior Publication Data

US 2006/0134955 A1 Jun. 22, 2006

(30) Foreign Application Priority Data

Dec. 22, 2004 (JP) ..... 2004-372198

(51) Int. Cl.
*H01H 51/22* (2006.01)

(52) U.S. Cl. ..... 335/78; 335/80; 335/83; 335/85; 335/159; 335/160; 335/161; 335/162; 335/196; 335/201

(58) Field of Classification Search ..... 335/78–86, 335/159–162, 196, 201
See application file for complete search history.

(56) References Cited

U.S. PATENT DOCUMENTS 5,359,305 A 10/1994 Kitamura et al.
5,886,601 A 3/1999 Kitamura et al.
6,486,760 B2 11/2002 Miyazaki et al.

FOREIGN PATENT DOCUMENTS

JP 6-076717 3/1984
JP 2000-164100 6/2000

OTHER PUBLICATIONS

English Language Abstract of JP 2000-164100.
English Language Abstract of JP 6-076717.

*Primary Examiner*—Ramon M. Barrera
(74) *Attorney, Agent, or Firm*—Greenblum & Bernstein, P.L.C.

(57) ABSTRACT

Provided is an electromagnetic relay which does not require a braided wire for securing a current capacity of a main contact unit. The electromagnetic relay includes a main contact unit inserted into a power supply path to a load and an arc contact unit connected in parallel to the main contact unit. An auxiliary contact unit is electrically independent of the main contact unit and the arc contact unit. The main contact unit includes a main fixed contact fixed to a frame body and a main contact spring made of a leaf spring and fitted with a main mobile contact which is attached to and detached from the main fixed contact. The arc contact unit and the auxiliary contact unit are arranged adjacent to each other. The main contact spring extends in a direction in which the arc contact unit and the auxiliary contact unit are arranged. Therefore, the main contact spring can be formed with a large length in the frame body and the sectional area can be enhanced without increasing a spring constant, thereby not requiring a braided wire.

9 Claims, 7 Drawing Sheets

ELECTROMAGNETIC RELAY

BACKGROUND

1. Technical Field

The present invention relates to an electromagnetic relay having a main contact unit which is inserted into a power supply path to a load and an arc contact unit which is connected in parallel to the main contact unit.

2. Related Art

Conventionally, as shown in FIG. 8, there is known an electromagnetic relay in which a main contact unit 2 and an arc contact unit 3 which are connected in parallel to each other are built in a frame body 1' and the main contact unit 2 and the arc contact unit 3 are inserted into a power supply path to a load (see JP-A-2000-164100).

The main contact unit 2 is made of a material having a small contact resistance and the arc contact unit 3 is made of a material having excellent adhesion resistibility. Therefore, by allowing the arc contact unit 3 to be closed after the main contact unit 2 is closed and allowing the arc contact unit 3 to be opened after the main contact unit 2 is opened, the opening and closing of the power supply path to the load can be performed mainly by the arc contact unit 3 having the adhesion resistibility and the power supply to the load can be performed mainly by the main contact unit 2 having small loss. That is, an electrical path for the main contact unit 2 requires a sectional area corresponding to a current capacity and thus in the relay disclosed in JP-A-2000-164100 (see paragraphs 0022 to 0023 and FIG. 15), the sectional area of the electrical path for the main contact unit 2 is secured by a main contact spring 23 and a braided wire 23', by connecting the braided wire 23' to the main contact spring 23 to which a main mobile contact 25 constituting the main contact unit 2 is attached.

As described above, since the electromagnetic relay having the configuration described in JP-A-2000-164100 requires the braided wire 23', a technique of facilitating the welding of the braided wire 23' has been suggested. In other words, since the braided wire 23' is essential, there is a problem with increase in the number of process steps for welding the braided wire 23'. In addition, since the braided wire 23' is required as an essential element of the main contact unit 2, there is a problem with increase in the number of elements.

SUMMARY

The present invention is contrived to solve the above-mentioned problems. It is an object of the present invention to provide an electromagnetic relay which does not require a braided wire by enhancing the sectional area of a main contact spring and which prevents increase in a spring constant of the main contact spring due to the enhancement of the sectional area of the main contact spring.

According to a first aspect of the present invention, there is provided an electromagnetic relay including a main contact unit which is inserted into a power supply path to a load, an arc contact unit which is connected in parallel to the main contact unit, an auxiliary contact unit which is electrically independent of the main contact unit and the arc contact unit, an electromagnet unit which includes an amateur block interlocking the main contact unit, the arc contact unit, and the auxiliary contact unit with each other, and a frame body which receives the main contact unit, the arc contact unit, the auxiliary contact unit, and the electromagnet unit, wherein the main contact unit includes a main fixed contact fixed to the frame body and a main contact spring made of a leaf spring and fitted with a main mobile contact which is attached to and detached from the main fixed contact, wherein the arc contact unit and the auxiliary contact unit are arranged adjacent to each other, and wherein the main contact spring extends in a direction in which the arc contact unit and the auxiliary contact unit are arranged.

In this configuration, since, among the main contact unit, the arc contact unit, and the auxiliary contact unit which are all received in the frame body, the arc contact unit and the auxiliary contact unit are arranged adjacent to each other and the main contact spring of the main contact unit extends in the direction in which the arc contact unit and the auxiliary contact unit are arranged, it is possible to set the length of the arc contact spring in the frame body to a relatively large value. That is, by increasing the length of the main contact spring while the sectional area of the main contact spring increases, it is possible to prevent a spring constant from increasing. As the result, it is possible to ensure the sectional area corresponding to a current capacity of the main contact unit without the braided wire. Furthermore, since the braided wire is not required, the number of elements and the number of process steps are reduced compared with a conventional configuration using the braided wire.

According to a second aspect of the present invention, in the first aspect, a partition wall which partitions the inside of the frame body into regions for receiving the main contact unit, the arc contact unit, and the auxiliary contact unit is provided in the frame body.

In this configuration, it is possible to prevent decrease in reliability generated by a phenomenon that powder wastes with high resistance which is generated at the time of opening and closing the arc contact unit is returned and attached to the other members in the frame body. In addition, by providing the partition wall, it is possible to increase a creeping distance between a strong electric field member such as the main contact unit and the arc contact unit and a weak electric field member such as the auxiliary contact unit and the electromagnet unit.

According to a third aspect of the present invention, in the second aspect, a part of the partition wall surrounds a region for receiving the electromagnet unit and positions and fixes the electromagnet unit to the frame body by coming in contact with the electromagnet unit.

In this configuration, since the partition wall which partitions the inside of the frame body is also used for positioning and fixing the electromagnet unit, the amount of the partition walls formed in the frame body can be relatively reduced and the space defined in the frame body can be efficiently used.

According to a fourth aspect of the present invention, in the first to third aspects, the electromagnet unit includes a mobile frame made of an insulating material which is disposed between the main contact unit and the arc contact unit and which opens and closes the main contact unit and the arc contact unit by reciprocating around an axis pin disposed at a predetermined position, and wherein an extension, which extends in a direction in which an end of the mobile frame separated from the axis pin is connected to the axis pin and which covers the main contact spring from the arc contact unit, is formed in the end of the mobile frame.

In this configuration, since the main contact spring is hidden from the arc contact unit by the extension formed in the mobile frame, the extension separates the main contact unit and the arc contact unit from each other and thus the powder wastes having a high resistance, which occurs by opening and closing the arc contact unit, is prevented from being attached to the main contact spring. In addition, since the main contact spring is hidden from the arc contact unit by the extension, it is possible to increase the creeping distance between the main contact unit and the arc contact unit over the surface of the mobile frame and prevent an operation failure due to the discharge between the main contact unit and the arc contact unit.

According to a fifth aspect of the present invention, in the first to fourth aspects, a plate-shaped terminal piece disposed in a coil terminal connected to a coil of the electromagnet unit and a plate-shaped terminal piece disposed in an auxiliary terminal plate of the auxiliary contact unit are protruded externally from the frame body.

In this configuration, by externally protruding the terminal piece of the coil terminal and the terminal piece of the auxiliary terminal plate from the frame body, the terminal piece connected with the external circuit is also used in a portion of the internal configuration in the frame body and a lead wire for electrically the terminal piece and the internal configuration need not be used, thereby not requiring a step of connecting the lead wire.

According to a sixth aspect of the present invention, in the first to fifth aspects, the frame body has a structure that a body, an intermediate body, and a cover arranged in a vertical direction are sequentially stacked, the intermediate body has an opening into which the electromagnet unit disposed between the body and the cover is inserted, a space for receiving a pair of the main contact unit and the arc contact unit connected in parallel to each other and a terminal base on which a terminal for connecting the main contact unit and the arc contact unit to the power supply path is disposed are formed between the body and the intermediate body, and a space for receiving another pair of the main contact unit and the arc contact unit connected in parallel to each other and a terminal base on which a terminal for connecting the main contact unit and the arc contact unit to the power supply path and a terminal of a transfer terminal plate inserted into the power supply path are selectively disposed are formed between the intermediate body and the cover.

In this configuration, if the main contact unit and the arc contact unit are received between the intermediate body and the cover and the terminal for connecting the main contact unit and the arc contact unit is disposed on the terminal base, it is possible to make an intermediate type configuration in which the main contact unit and the arc contact unit are inserted into two wires which become the power supply path of a load path, respectively. Furthermore, if the terminal of the transfer terminal plate inserted into the power supply unit of the load path is disposed in the terminal base between the intermediate body and the cover, it is possible to make a segregate type configuration in which the main contact unit and the arc contact unit are inserted into one of the two wires which become the power supply unit of the load path. Accordingly, only by changing the member disposed between the intermediate body and the cover, it is possible to make the intermediate type and segregate type electromagnetic relay while the other member are commonly used. That is, it is possible to reduce cost due to a mold or inventory management by commonly using the members. In addition, since the body, the intermediate body, and the cover are sequentially stacked, the members attached to the body and the members attached to the intermediate body may be checked, respectively, and quality management can be facilitated.

According to a seventh aspect of the present invention, in the first to sixth aspects, an attraction yoke, which is made of a magnetic substance, which forms a magnetic flux path around the main contact spring, and which has a magnetic force in a direction in which the main mobile contact is brought into contact with the main fixed contact, is disposed in the frame body.

In this configuration, when large current such as short-circuited current passes through the main contact unit, the main mobile contact can come in contact with the main fixed contact by a strong attraction force generated between the main contact spring and the attraction yoke and the adhesion between the main mobile contact and the main fixed contact can be prevented.

BRIEF DESCRIPTION OF THE DRAWINGS

The above and other features and advantages of the present invention will become more apparent by describing in detail exemplary embodiments thereof with reference to the attached drawings in which.

DESCRIPTION OF EXEMPLARY EMBODIMENTS

Hereinafter, exemplary embodiments of the present invention will be described in detail with reference to the attached drawings.

Figure 2:
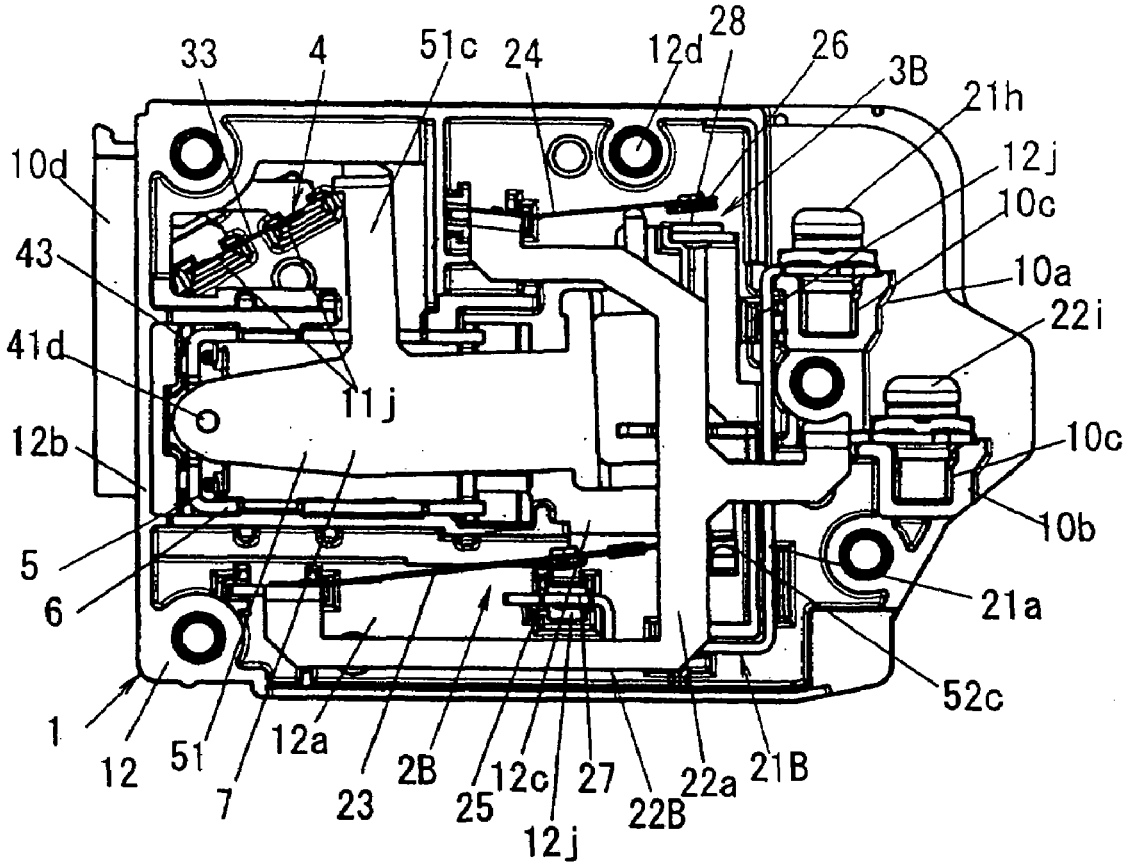
FIG. 2 is a plan view illustrating a state of the electromagnetic relay according to the embodiment of the invention from which a cover is separated.
Figure 3:
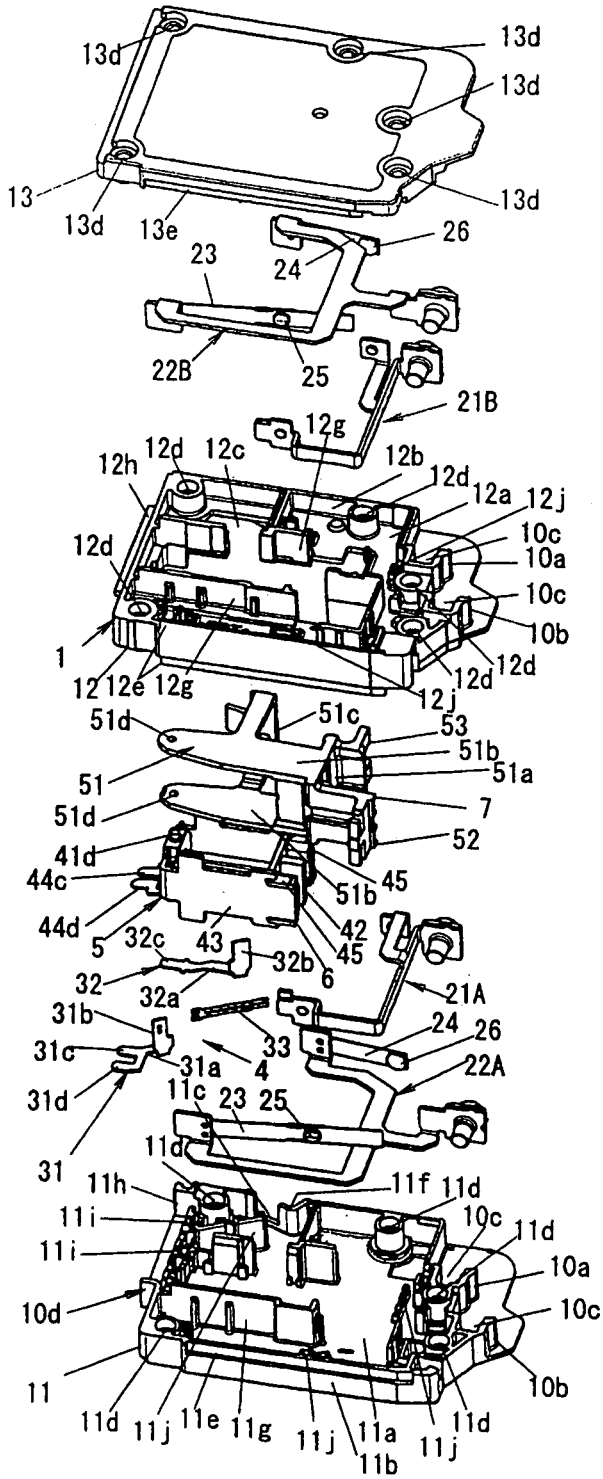
FIG. 3 is an exploded perspective view illustrating an electromagnetic relay according to an embodiment of the invention.

An electromagnetic relay according to an embodiment of the invention has a frame body 1 including a body 11, an intermediate body 12, and a cover 13, as shown in FIG. 3. Main contact units 2A and 2B, arc contact units 3A and 3B, an auxiliary contact unit 4, and an electromagnet 5, which are all described in detail later, are received in the frame body 1 (see FIGS. 1 and 2). The body 11, the intermediate body 12, and the cover 13 are made of, for example, poly butylene terephthalate (PBT).

The body 11 has a shape that an outer circumferential wall 11*b* protrudes along the rim of a side plate 11*a* from a surface (a top surface in FIG. 3) in the thickness direction of the side plate 11*a*. That is, the body 11 has a shape that one surface in the thickness direction of the side plate 11*a* is opened and the other surface is closed.

The intermediate body 12 overlaps with the opening of the body 11 in the thickness direction of the side plate 11*a*. The intermediate body 12 has an intermediate plate 12*a* which is opposed to the side plate 11*a* of the body 11 in the state where the intermediate body 12 overlaps with the body 11. An outer circumferential wall 12*b* protrudes from one surface (a top surface in FIG. 3) in the thickness direction of the intermediate plate 12*a* so as to almost correspond with the outer circumferential wall 11*b* of the body 11 in the state where the intermediate body 12 overlaps with the body 11. Accordingly, the intermediate body 12 has a shape that one surface in the thickness direction of the intermediate plate 12*a* is opened similarly to the body 11. However, an opening 12*c* is formed at the center portion of the intermediate plate 12*a* of the intermediate body 12.

The cover 13 overlaps with the opening of the intermediate body 12 in the thickness direction of the intermediate plate 12*a* of the intermediate body 12. The cover 13 has a plate shape and is opposed to the intermediate plate 12*a* of the intermediate body 12 in the state where the cover 13 overlaps with the intermediate body 12. The outer circumferential shape of the side plate 11*a* of the body 11, the intermediate plate 12*a* of the intermediate body 12, and the cover 13 are almost equal to each other.

The body 11, the intermediate body 12, and the cover 13 are coupled to each other by the use of five caulking pins not shown. Fixing holes 11*d*, 12*d*, and 13*d* are formed at the positions of the body 11, the intermediate body 12, and the cover 13 into which the caulking pins should be inserted. The fixing holes 11*d*, 12*d*, and 13*d* are disposed inside the outer circumferential walls 11*b* and 12*b* and are formed in the edges of the frame body 1 or in the vicinity of terminals to be described later. The fixing holes are disposed in the vicinity of the terminals in order to prevent a crack from being generated in the frame body 1 due to an external force at the time of connecting or disconnecting a wire to or from the terminals. Engagement protrusions 12*e* engaging with engagement grooves 11*e* and 13*e* formed in the outer circumferences of the body 11 and the cover 13 are formed in the outer circumference of the intermediate body 12. By allowing the engagement grooves 11*e* and 13*e* to engage with the engagement protrusions 12*e*, the body 11, the intermediate body 12, and the cover 13 are positioned.

A so-called double-cut type electromagnetic relay having two pairs of contacts which are inserted into two cables, respectively, serving as a power supply path to a load from a power source is shown as a specific example in FIG. 3. Each pair is provided with the main contact unit 2A or 2B and the arc contact unit 3A or 3B. The main contact unit 2A and the arc contact unit 3A are connected in parallel to each other and the main contact unit 2B and the arc contact unit 3B are connected in parallel to each other.

Figure 4:
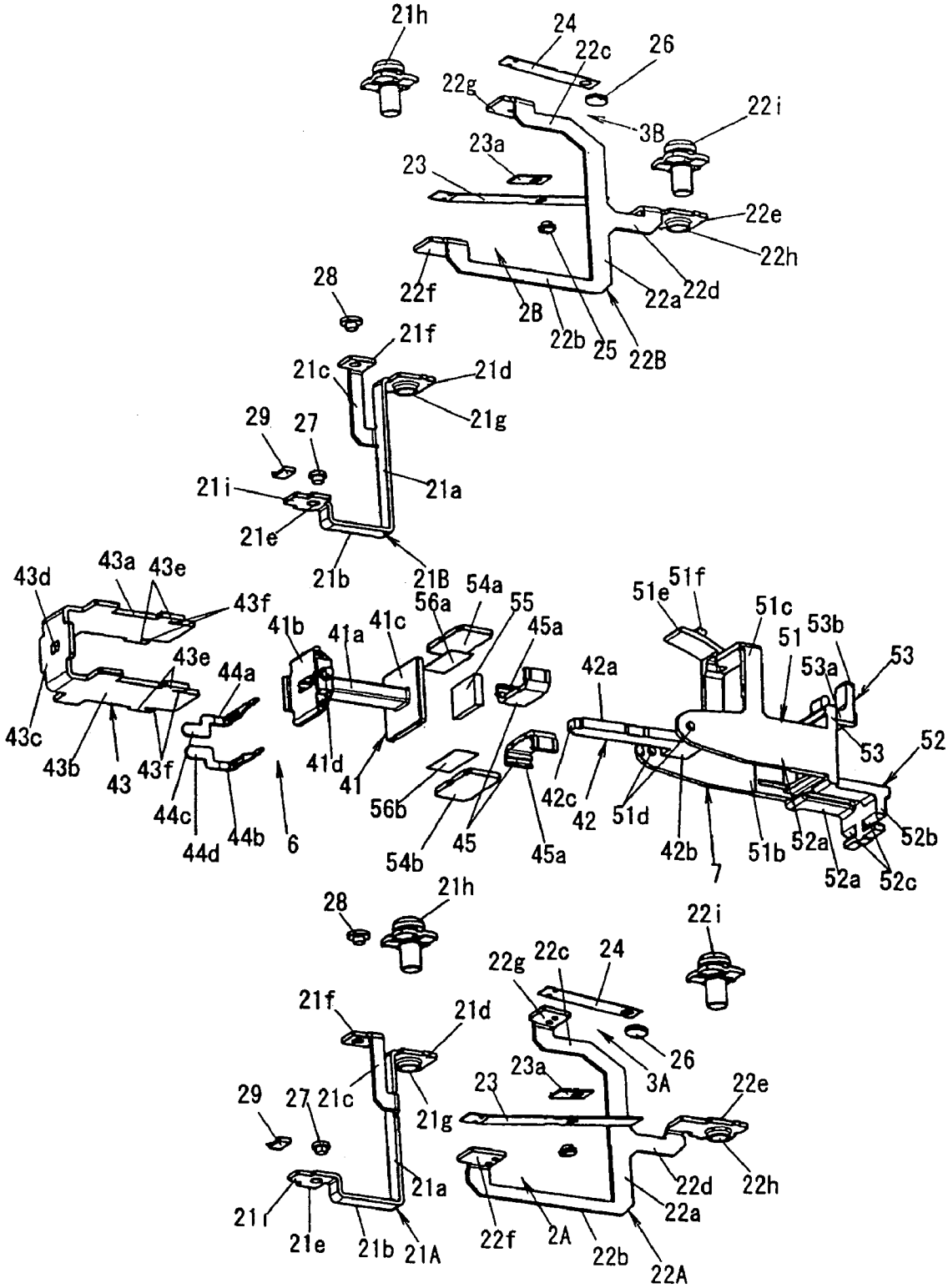
FIG. 4 is an exploded perspective view illustrating a main part of an electromagnetic relay according to an embodiment of the invention.

Now, the main contact units 2A and 2B and the arc contact units 3A and 3B are specifically described with reference to FIG. 4. The main contact units 2A and 2B and the arc contact units 3A and 3B have fixed-side terminal plates 21A and 21B, mobile-side terminal plates 22A and 22B, main contact springs 23 made of a leaf spring, and arc contact springs 24 made of a leaf spring as major elements. Main mobile contacts 25 are fixed to longitudinal intermediate portions of the main contact springs 23, respectively and arc mobile contacts 25 are fixed to the arc contact springs 24. Main fixed contacts 27 from which the main mobile contacts 25 are detached and arc fixed contacts 28 from which the arc mobile contacts 26 are fixed to the fixed-side terminal plates 21A and 21B. Here, a material having a small contact resistance is selected for the main mobile contacts 25 and the main fixed contacts 27, and a material having adhesion resistibility is selected for the arc mobile contacts 26 and the arc fixed contacts 28.

The fixed-side terminal plates 21A or 21B have an L shape having a main piece 21*a* and a first branched piece 21*b* disposed along two adjacent surfaces in the outer circumferential walls 11*b* and 12*b* of the frame body 1. A second branched piece 21*c* of which the thickness direction is almost perpendicular to the thickness of the main piece 21*a* is branched from a side edge of a longitudinal intermediate portion of the main piece 21*a*. One end in the length direction of the main piece 21*a* is provided with the first branched piece 21*b* extending in one thickness direction of the main piece 21 as described above and the other end in the length direction of the main piece 21*a* is provided with a terminal piece 21*d* extending in the opposite thickness direction of the main piece 21*a*. A main contact fixing piece 21*e* to which the main fixed contact 27 is fixed and which is almost parallel to the first branched piece 21*b* extends from the end of the first branched piece 21*b*. An arc contact fixing piece 21*f* to which the arc fixed contact 28 is fixed and which is almost parallel to the main contact fixing piece 21*e* is provided to the end of the second branched piece 21*c*.

A screw hole 21*g* is formed at the center of the terminal piece 21*d* and a terminal screw 21*h* fitted with a washer is coupled to the screw hole 21*g*. An extension piece 21*i* extends from a rim opposite to a rim of the main contact fixing piece 21*e* connected to the first branched piece 21*b* in the extending direction of the first branched piece 21*b*, and an attraction yoke 29 made of a magnetic substance is adhered to the extension piece 21*i*. The attraction yoke 29 has a center piece disposed at the same side as the main fixed contact 27 in the thickness direction of the main contact fixing piece 21*e*, and, in the center piece, the section thereof has a ⊐shape in which a pair of legs is protruded from the both ends in the width direction of the first branched piece 21*b*.

The mobile-side terminal plates 22A and 22B have main pieces 22*a* of which the thickness directions are substantially perpendicular to those of the main pieces 21*a* of the fixed-side terminal plates 21A and 21B, a branched piece 22*b* extends from one end in the length direction of the main piece 22*a* in a direction substantially perpendicular to the extending direction of the main piece 22*a*, and a second branched piece 22*c* extends from the other end in the length direction of the main piece 22*a* substantially parallel to the first branched piece 22*b*. Furthermore, a third branched piece 22*d* extends from the side edge in the center in the length direction of the main piece 22*a* in an opposite direction of the first branched piece 22*b* and the second branched piece 22*c*. The first branched piece 22*b* has a length longer than that of the second branched piece 22*c*. The front end of the third branched piece 22*d* is provided with a terminal piece 22*e* which is substantially parallel to the third branched piece 22*d* or of which the thickness direction is substantially perpendicular to the third branched piece 22*d*. The front end of the first branched piece 22*b* is provided with a spring fixing piece 22*f* which is substantially parallel to the extending direction of the first branched piece 22*b* or of which the thickness direction is substantially perpendicular to the extending direction of the first branched piece 22*b*. One end in the length direction of the main contact spring 23 is caulked and adhered to the spring fixing piece 22*f*. In addition, the front end of the second branched piece 22*c* is provided with a spring fixing piece 22*g* to which one end in the length direction of the arc contact spring 23 is caulked and adhered.

The main contact spring 23 is arranged such that one end opposite to the other end adhered to the spring fixing piece

22*f* is close to the main piece 22*a* and the arc contact spring 24 is arranged such that one end opposite to the other end adhered to the spring fixing piece 22*g* is close to the main piece 22*a*. A conductive plate 23 is stacked at the center in the length direction of the main contact spring 23. The conductive plate 23 is adhered to the main contact spring 23 at the same time of caulking the main mobile contact 25 to the main contact spring 23. A screw hole 22*h* is formed at the center of the terminal piece 22*e* and a terminal screw 22*i* fitted with a washer is coupled to the screw hole 22*h*.

Here, although the fixed-side terminal plate 21A and the fixed-side terminal plate 21B have the same shape, and are symmetrically formed with respect to the symmetrical surface parallel to the second branched piece 21*c*. In addition, the same is true in the relationship between the mobile-side terminal plate 22A and the mobile-side terminal plate 22B and the mobile-side terminal plate 22A and the mobile-side terminal plate 22B are symmetrically formed with respect to the symmetrical surface parallel to the main piece 22*a*.

Figure 1:
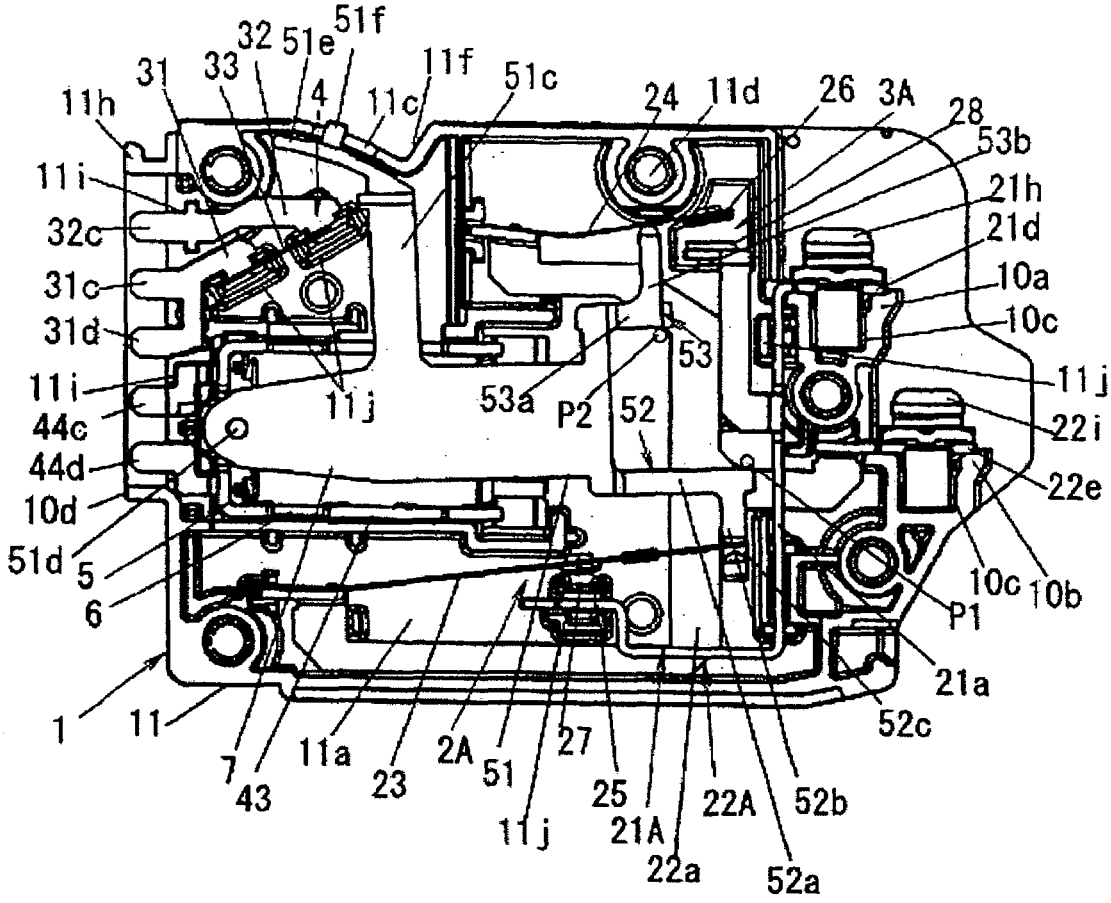
FIG. 1 is a plan view illustrating a state of an electromagnetic relay according to an embodiment of the invention from which an intermediate body is separated.

The fixed-side terminal plates 21A and 21B and the mobile-side terminal plates 22A and 22B are received in the frame body 1 in the state of mounting the main contact spring 23, the arc contact spring 24, the main mobile contact 25, the arc mobile contact 26, the main fixed contact 27, and the arc fixed contact 28. In the body 11, as illustrated in FIG. 1, the mobile-side terminal plate 22A is disposed between the side plate 11*a* and the mobile-side terminal plate 21A. Meanwhile, in the intermediate body 12, as illustrated in FIG. 2, the fixed-side terminal plate 21B is disposed between the intermediate plate 12*a* and the mobile-side terminal plate 22B. Accordingly, the fixed-side terminal plate 21A and the mobile-side terminal plate 22B cross each other in the body 11 in three dimensions, and the fixed-side terminal plate 21B and the mobile-side terminal plate 22B cross each other in the intermediate body 12 in three dimensions. By the above-mentioned configuration, since the electrical connection between the main contact units 2A and 2B and the arc contact unit 3A and 3B is performed in the fixed-side terminal plate 21A and 21B and the mobile-side terminal plates 22A and 22B, a separate member need not be used for the electrical connection between the main contact units 2A and 2B and the arc contact units 3A and 3B and thus the number of the elements is reduced.

The space surrounded with the side plate 11*a* and the outer circumferential wall 11*b* in the body 11 is partitioned into four regions by the partition wall *g*. The space surrounded with the intermediate plate 12*a* and the outer circumferential wall 12*b* in the intermediate body 12 is partitioned into four regions by the partition wall 12*g*. Two regions among six regions in the body 11 and the intermediate body 12 are independent of each other in the body 11 and the intermediate body 12 and the remaining two regions communicate with each other through the hole 12*c* formed in the intermediate body 12.

The main contact fixing piece 21*e* and the first branched piece 21*b* to which the main fixed contact 27 is fixed and the spring fixing piece 22*f* and the first branched piece 22*b* to which the main contact spring 23 is fixed are received in one of the two independent regions. The arc contact fixing piece 21*f* and the second branched piece 21*c* to which the arc fixed contact 28 is fixed and the spring fixing piece 22*g* and the second branched piece 22*c* to which the arc contact spring 24 is fixed are received in the other of the two independent regions. The two regions are regions allowing the inner spaces of the body 11 and the intermediate body 12 to communicate with each other at the center of the intermediate body 12 and are disposed with the region therebetween, which receives the electromagnet unit 5. The region for receiving the main contact spring 23 and the main fixed contact 27 has a greater size in the extending direction of the main contact spring 23 than that of the region for receiving the arc contact spring 24 and the arc fixed contact 28. Accordingly, the main contact spring 23 can be formed longer than the arc contact spring 24.

As described above, since the region for receiving the main contact units 2A and 2B and the region for receiving the arc contact units 3A and 3B are disposed with the region for receiving the electromagnet unit 5 therebetween in the frame body 1, the distance between the main contact units 2A and 2B and the arc contact units 3A and 3B can be set relatively great in the defined space in the frame body 1. In addition, since the partition wall 11*g* surrounding the region for receiving the electromagnet unit 5 is used in common for fixing the electromagnet unit 5 as well as partitioning the regions, it is not necessary to provide an additional member for fixing the electromagnet unit 5, thereby simplifying the structure. That is, the amount of the partition wall 11*g* formed in the frame body 1 can be made relatively small.

As shown in FIGS. 1 and 2, two terminal bases 10*a* 10*b* are formed in each of the body 11 and the intermediate body 12 at portions, which are adjacent to the two independent regions, of the outer circumferential wall 11*b* of the body 11 and the outer circumferential wall 12*b* of the intermediate body 12. The respective terminal bases 10*a* and 10*b* have a receiving groove 10*c* in which the terminal pieces 21*d* and 22*e* are placed and into which the terminal screws 21*h* and 22*i* are inserted. In the receiving grooves 10*c* of the terminal bases 10*a* and 10*b* provided in the body 11, the surface opposed to the intermediate body 12 is opened and in the receiving grooves 10*c* of the terminal bases 10*a* and 10*b* provided in the intermediate body 12, the surface opposed to the cover 13 is opened. The remaining region in which the inner spaces of the body 11 and the intermediate body 12 communicate with each other through the hole 12*c* of the intermediate body 12 is disposed adjacent to the region for receiving the arc contact spring 24 in the extending direction of the main contact spring 23 and the auxiliary contact unit 4 is received in the region. In other words, the main contact spring 23 extends in the direction in which the arc contact units 3A and 3B and the auxiliary contact unit 4 are arranged. The auxiliary contact unit 4 is opened or closed interlocking with the main contact units 2A and 2B and the arc contact units 3A and 3B and serves to inform other apparatuses of the opening or closing status of the power supply path to a load or to take out the operation status of the electromagnet unit 5 as an external output. As can be apparently seen from the description, the strong current system such as the main contact units 2A and 2B and the arc contact units 3A and 3B and the weak current system such as the auxiliary contact unit 4 and the electromagnet unit 5 can be separated from each other with the partition wall 11*g*.

As shown in FIG. 3, the auxiliary contact unit 4 includes two auxiliary terminal plates 31 and 32 and an auxiliary contact spring 33 fixed to one auxiliary terminal plate 31 through caulking. The auxiliary terminal plate 31 includes a main piece 31*a* disposed along the inner side surface of the side plate 11*a* of the body 11, a spring fixing piece 31*b* extending in the direction perpendicular to the side plate 11*a* from the side edge of an end of the main piece 31*a*, and two terminal pieces 31*c* and 31*d* forked from the other end of the main piece 31*a*. The auxiliary terminal plate 32 includes a main piece 32*a* disposed along the inner side surface of the side plate 11*a* of the body 11, a contact piece 32*b* extending in the direction perpendicular to the side plate 11*a* from the side edge of an end of the main piece 32*a*, and a terminal piece 32*c* extending from the other end of the main piece 32*a*. The auxiliary spring 33 is a leaf spring and has a shape that two independent springs are provided with a slit extending from the vicinity of one end thereof to the other end. An end of the auxiliary contact spring 33 is fixed to the spring fixing piece 31*b* of the auxiliary terminal plate 31 and the other end of the auxiliary contact spring 33 is disposed to be detachable from the contact piece 32*b* of the auxiliary terminal plate 32.

Figure 5:
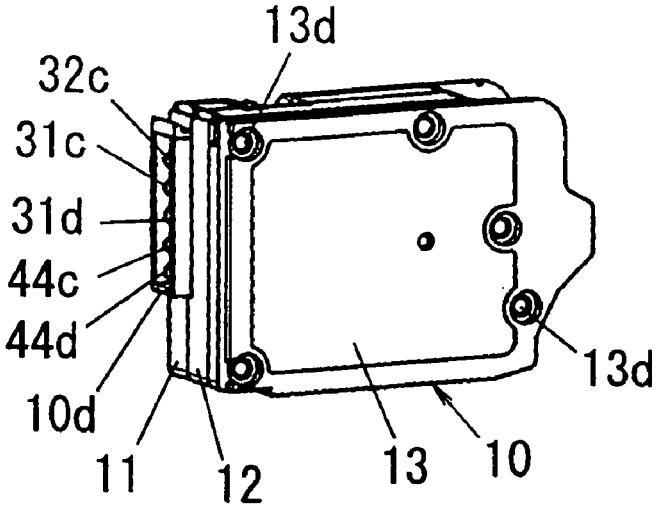
FIG. 5 is an outside perspective view illustrating an electromagnetic relay according to an embodiment of the invention.

As shown in FIGS. 1 and 5, the terminal pieces 31*c*, 31*d*, and 32*c* are received in a coupling box 10*d* penetrating the outer circumferential wall 11*b* of the body 11 and protruding outwardly from the outer surface of the frame body 1. The respective terminal pieces 31*c*, 31*d*, and 32*c* have a plate shape and are arranged in a line perpendicular to the thickness direction. That is, the terminal pieces 31*c*, 31*d*, and 32*c* are arranged on a plane. In the coupling box 10*d*, the surface (the end surface in the axis direction of the coupling box 10*d*) parallel to the surface, from which the terminal pieces 31*c*, 31*d*, and 32*c* protrude, of the outer circumferential wall 11*b* of the body 11 is opened. That is, the coupling box 10*d* has an opening perpendicular to the extending direction of the terminal pieces 31*c*, 31*d*, and 32*c*. The coupling box 10*d* includes a receiving box portion 11*h* having a shaped section of which one end surface protruding from the outer surface of the outer circumferential wall 11*b* of the body 11 is opened and a cover piece 12*h* covering the opened end of the receiving box portion 11*h*. In the outer circumferential wall 11*b* of the body 11 which is the other end surface in the axis direction of the coupling box 10*d*, the surface (the top surface in FIG. 3) of the body 11 contacting the intermediate body 12 is opened to form a fixing groove 11*i* into which the terminal pieces 31*c*, 31*d*, and 32*c* are fitted. Therefore, the auxiliary terminal plates 31 and 32 can be fitted to the body 11 through the surface of the body 11 contacting the intermediate body 12. Terminal pieces 44*c* and 44*d* provided in the electromagnet unit 5 are disposed in the coupling box 10*d*. The terminal pieces 44*c* and 44*d* have a plate shape and are arranged on the same plane as the terminal pieces 31*c*, 31*d*, and 32*c*. Accordingly, five terminal pieces 31*c*, 31*d*, 32*c*, 44*c*, and 44*d* are arranged in a line in the coupling box 10*d*.

A plurality of holding ribs 11*j* and 12*j* are formed at appropriate portions of the inner surface of the side plate 11*a* of the body 11 and the surface of the intermediate plate 12*a* opposed to the cover 13 and the fixed-side terminal plates 21A and 21B, the mobile-side terminal plates 22A and 22B, and the auxiliary terminal plates 31 and 32 are fixed to the body 11 and the intermediate body 12 by fitting their parts to the holding ribs 11*j* and 12*j*. The main contact spring 23 is of a flexure type and the main mobile contact 25 and the main fixed contact 27 constitute a normally open contact. The arc contact spring 24 is of a lift-off type and the arc mobile contact 26 and the arc fixed contact 28 constitute a normally closed contact.

Next, the electromagnet unit 5 will be described in detail. The electromagnet unit 5 includes a coil block 6 having a coil (not shown) and an amateur block 7 which is pivoted on the coil block 6 to reciprocate between two defined positions, as shown in FIG. 3. As shown in FIG. 4, the coil block 6 includes a coil bobbin 41 molded out of synthetic resin, an iron core 42 made of a magnetic substance of which a part is inserted into the coil bobbin 41, and a yoke 43 which is mechanically and magnetically coupled to one end in the length direction of the iron core 42 and which is made of a magnetic substance. The amateur block 7 includes a mobile frame 51 molded out of synthetic resin (for example, PBT), two magnetic pole plates 54*a* and 54*b* fixed to the mobile frame 51, and a permanent magnet 55 which is disposed between both magnetic pole plates 54*a* and 54*b* so as to magnetize the magnetic pole plates 54*a* and 54*b* into different magnetic poles.

The coil bobbin 41 has a prism-shaped axis portion 41*a* around which the coil is wound and flange portions 41*b* and 41*c* extending integrally from both ends in the length direction of the axis portion 41*a*. Two coil terminals 44*a* and 44*b* passes through one flange portion 41*b*. The respective coil terminals 44*a* and 44*b* have an L shape. An end of the coil is connected to an end of the respective coil terminals 44*a* and 44*b* passing through the flange portion 41*b* and terminal pieces 44*c* and 44*d* are provided at the other end of the respective coil terminals 44*a* and 44*b*.

The iron core 42 has a T shape including a leg piece 42*a* passing through the coil bobbin 41 in the length direction of the axis portion 41*a* and a magnetic pole piece 42*b* extending from one end in the length direction of the leg piece 42*a* and having a width greater than that of the leg piece 42*a*. A coupling piece 42*c* protrudes from the other end in the length direction of the leg piece 42*a*. The magnetic pole piece 42*b* and the coupling piece 42*c* protrude from both ends of the coil bobbin 41, respectively.

The yoke 43 has a ⊐shape including a pair of leg pieces 43*a* and 43*b* and a center piece 43*c* connecting the ends in the length direction of both leg pieces 43*a* and 43*b* to each other. An insertion hole 43*d* into which the coupling piece 42*c* of the iron core 42 is inserted is formed at the center of the center piece 43*c* and the iron core 42 and the yoke 43 are mechanically coupled to each other by caulking the coupling piece 42*c* after inserting the coupling piece 42*c* into the insertion hole 43*d*. One end of the respective leg pieces 43*a* and 43*b* of the yoke 43 extends to a portion of the iron core 42 opposed to the magnetic pole piece 32*b* (see FIG. 3) and fitting pieces 43*e* protrude from both sides of the end of the respective leg pieces 43*a* and 43*b*. Fitting grooves 43*f* cut into along the length direction of the leg pieces 43*a* and 43*b* from the ends of the leg pieces 43*a* and 43*b* are formed at the base ends of the fitting pieces 43*e*.

Auxiliary yokes 45 opposed to the magnetic pole pieces 42*b* provided in the iron core 42 are fitted to the end of the respective leg pieces 43*a* and 43*b*. The auxiliary yokes 45 have a ⊂ shape and fixing grooves 45*a* fitted to both sides in the width direction of the respective leg pieces 43*a* and 43*b* of the yoke 43 are formed in the inner surfaces of the auxiliary yokes 45. That is, by positioning the fixing grooves 45*a* of the auxiliary yokes 45 at both sides of the leg pieces 43*a* and 43*b* of the yoke 43 and allowing the auxiliary yoke 45 to slide from the ends of the leg pieces 43*a* and 43*b* of the yoke 43, the auxiliary yokes 45 can be fitted to the yoke 43.

By allowing the auxiliary yokes 45 to come in contact with the flange portion 41*c* of the coil bobbin 41 and inserting a part of the auxiliary yoke 45 into the fitting grooves 43*f*, the leg pieces of the yoke 43 are positioned in the length direction. By caulking the auxiliary yoke 45 into the yoke 43 or caulking the fitting pieces 43*e* into the auxiliary yokes 45, the auxiliary yokes 45 are fixed to the yoke 43. Here, the auxiliary yokes 43 are disposed to protrude toward the opposed surfaces of both leg pieces 43*a* and 43*b* of the yoke 43. Therefore, the gap between the auxiliary yokes 45 and the magnetic pole piece 42*b* of the iron core 42 can be set smaller than the gap between the leg pieces 43*a* and 43*b* of the yoke 43 and the magnetic pole piece 42*b* of the iron core 42. That is, by changing the existence of the auxiliary yokes 45 or the shape of the auxiliary yoke 45, the electromagnet unit 5 having different specifications can be provided.

Axis pins 41*d* protrude integrally from both sides of the surrounding surface of the flange portion 41*b* of the coil bobbin 41 in the direction in which the coil terminals 44*a* and 44*b* are inserted. The mobile frame 51 is axially fixed to the coil bobbin 41 by inserting the axis pins 41*d* into axis holes 51*d* formed in the mobile frame 51.

The mobile frame 51 has a main frame portion 51*a* of a quadrangular frame shape and side frame plates 51*b* extending from two opposed sides of the main frame portion 51*a* to be opposed to each other. An auxiliary frame portion 51*c* having a ⊂ shape which extends integrally from both side frame plates 51*bd* section is disposed at the intermediate portion of both side frame plates 51*b*. A main card portion 52 and an arc card portion 53 are disposed to extend in the opposite direction of the side frame plates 51*b* from the remaining two sides of the main frame portion 51*a*. A manipulation piece 5*e* having an arc-shaped section is disposed to extend from the auxiliary frame portion 51*c* and a manipulation protrusion 51*f* protrudes from one surface of the manipulation piece 51*e*. The manipulation protrusion 51*f* is exposed to the outside of the frame body 1 through a manipulation opening 11*c* opened in the outer circumferential wall 11*b* of the body 11. By manipulating the manipulation protrusion 51*f* with an appropriate tool such as a minus driver or a finger, the mobile frame 51 can be allowed to manually rotate around the axis pins 41*d*. The manipulation opening 11*c* is opened in the inner circumferential wall of a concave portion 11*f* provided on the surface other than the surface from which the terminal pieces 31*c*, 31*d*, and 32*c* protrude, that is, a portion of the outer circumferential wall 11*b* of the body 11 surrounding the region for receiving the auxiliary contact unit 4. That is, since the manipulation protrusion 51*f* is disposed in the concave portion 11*f*, it is possible to prevent the manipulation protrusion 51*f* from being carelessly manipulated.

The axis holes 51*d* into which the axis pins 41*d* are inserted are disposed at the ends of the side frame plates 51*b* apart from the main frame portion 51*a*. Accordingly, the mobile 51 can rotate around the axis pins 41*d* in the state that the axis pins 41*d* are inserted into the axis holes 51*d*. The portions of both side frame plates 51*b* close to the main frame portion 51*a* are fitted with magnetic pole plates 54*a* and 54*b* and a permanent magnet 55. That is, both magnetic pole plates 54*a* and 54*b* and the permanent magnet 55 are interposed between both side frame plates 51*b* in the state that the permanent magnet 55 is interposed between both magnetic pole plates 54*a* and 54*b* and the magnetic pole plates 54*a* and 54*b* are magnetized into different polarities with the permanent magnet 55. Grooves (not shown) for positioning the magnetic pole plates 54*a* and 54*b* and the permanent magnet 55 are formed in the side frame plates 51*b*. Residual plates 56*a* and 56*b* for facilitating the separation of two members contacting each other with a magnetic force are attached to the opposed surfaces of the magnetic pole plates 54*a* and 54*b*, respectively.

The magnetic pole plates 54*a* and 54*b* are inserted between the ends of the leg pieces 43*a* and 43*b* and the magnetic pole piece 42*b* of the iron core 42. That is, one magnetic pole plate 54*a* moves between the auxiliary yoke 45 disposed in one leg piece 43*a* of the yoke 43 and the magnetic pole piece 43*b* of the iron core 42 and the other magnetic pole plate 54*b* moves between the auxiliary yoke 45 disposed in the other leg piece 43*b* of the yoke 43 and the magnetic pole piece 42*b* of the iron core 42. The gap between both magnetic pole plates 54*a* and 54*b* is equal to the distance between the auxiliary yoke 45 opposed to one surface of the magnetic pole piece 42*b* of the iron core 42 and the other surface of the magnetic pole piece 42*b* of the iron core 42. Accordingly, when the coil terminals 44*a* and 44*b* are supplied with current, a closed magnetic path of the leg piece 43*a* of the yoke 43—the auxiliary yoke 45—the magnetic pole plate 54*a*—the permanent magnet 55—the magnetic pole plate 54*b*—the iron core 42—the center piece 43*c* of the yoke 43 and a closed magnetic path of the leg piece 43*b* of the yoke 43—the auxiliary yoke 45—the magnetic pole plate 54*b*—the permanent magnet 55—the magnetic pole plate 54*a*—the iron core 42—the center piece 43*c* of the yoke 43 are selectively formed in accordance with the direction of the current flowing in the coil, thereby allowing the mobile frame 51 to reciprocate around the axis pins 41*d*.

The main card portion 52 has an L shape including an extension 52*a* protruding in the opposite direction of the side frame plate 51*b* from the main frame portion 51*a* and a contact driving portion 52*b* extending in the direction perpendicular to the extension 52*a* from the end of the extension 52*a*. That is, the extension 52*a* extends in the direction in which the end having the main frame portion 51*a* and the axis pins 41*d* in the mobile frame 51. Driving grooves 52*c* into which the ends of the main contact spring 23 fixed to the mobile-side terminal plates 22A and 22B are inserted are formed at both edges in the width direction of the contact driving portion 52*b*. On the other hand, the arc card portion 53 has an L shape including an extension 53*a* protruding in the opposite direction of the side frame plate 51*b* from the main frame portion 51*a*, a contact driving portion 53*b* extending in a direction perpendicular to the extension 53*a* from the end of the extension 53*a*. Two contact driving portions 53*b* are provided, thereby allowing the respective contact driving portions 53*b* to press the intermediate portion of the arc contact spring 24 fixed to the mobile-side terminal plates 22A and 22B.

The extension 52*a* of the main card portion 52 has a length greater than that of the extension 53*a* of the arc card portion 53. The contact driving portion 52*b* of the main card portion 52 and the contact driving portion 53*b* of the arc card portion 53 protrude in the directions opposite to each other. Since the main contact spring 23 is of a flexure type, the main mobile contact 25 is brought into contact with the main fixed contact 27 by allowing the driving grooves 52*c* to press the main contact spring 23. Since the arc contact spring 24 is of a lift-off type, the arc mobile contact 26 is brought into contact with the arc fixed contact 28 by separating the contact driving portion 53*b* from the arc contact spring 23. Since the main contact spring 23 is inserted into the driving grooves 52*c*, it is possible to deliver the driving force of the mobile frame 51 to the main contact spring 23 and to draw out the main contact spring, even when the main mobile contact 25 is adhered to the main fixed contact 27 but the adhesion is weak. When the width of the driving grooves 52*c* is set greater than the thickness of the main contact spring 23 by a margin and the main mobile contact 25 is weakly adhered to the main fixed contact 27, the main contact spring 23 can be drawn out by allowing impact to act on the main contact spring 23 from the mobile frame 51. In addition, since the extension 52*a* of the main card portion 52 has a length greater than that of the extension 53*a* of the arc card portion 53 and the main contact spring 23 has a length greater than that of the arc contact spring 24 so as to fix the main mobile contact 25 to the intermediate portion in the length direction of the main contact spring 23, a relatively large force can be applied to the main mobile frame 25 from the mobile frame 51 by the use of a lever rule, thereby drawing out the main mobile contact 25 when the main mobile contact 25 is adhered to the main fixed contact 27.

Since the extensions 52*a* and 53*a* have the same plate shape and the extension 52*a* covers the main contact spring 23 from the arc contact units 3A and 3B, the extension 52*a* serves to separate the main contact units 2A and 2B from the arc contact units 3A and 3B and the creeping distance between the main contact units 2A and 2B and the arc contact units 3A and 3B increases due to the existence of the extensions 52*a* and 53*a*. That is, by preventing the creeping discharge between the main contact units 2A and 2B and the arc contact units 3A and 3B, it is possible to satisfactorily break the power supply path to a load when the main contact units 2A and 2B and the arc contact units 3A and 3B are opened.

Since two extensions 52*a* and 52*b* extending in the length direction of the side frame plate 51*b* are disposed at the positions apart from the axis hole 51*d* of the mobile frame 51 and both extensions 52*a* and 53*a* are spaced apart from each other in the width direction of the side frame plate 51*b*, a measure of a measuring device such as a tension meter can be inserted between both extensions 52*a* and 53*a* (where the measuring position is, for example, portions indicated by reference numerals P1 and P2 in FIG. 1) and the fixing force of the amateur block 7 in the electromagnet unit 5 can be easily measured.

The end of the auxiliary contact spring 33 comes in contact with the auxiliary frame portion 51*c*. The auxiliary contact spring 33 is of a flexure type. The auxiliary contact spring 33 is pressed on the auxiliary frame portion 51*c* and moves in the same direction as the main contact spring 23, when the mobile frame 51 rotates around the axis pins 41*d*. That is, when the main mobile contact 25 fixed to the main contact spring 23 comes in contact with the main fixed contact 27, the auxiliary contact spring 33 comes in contact with the contact piece 32*b* of the auxiliary terminal plate 32 and when the main mobile contact 25 is separated from the main fixed contact 27, the auxiliary contact spring 33 is separated from the contact piece 32*b* of the auxiliary terminal plate 32. In other words, since the opening or closing status of the auxiliary contact unit 4 including the auxiliary terminal plates 31 and 32 and the auxiliary contact spring 33 is equal to the opening or closing status of the main contact units 2A and 2B, it is possible to confirm the operation status of the main contact units 2A and 2B by monitoring the opening or closing status of the auxiliary contact unit 4.

However, since the main contact spring 23 is of a flexure type, the main mobile contact 25 is kept in contact with the inner circumferential surface of the base side of the contact driving portion when the main mobile contact 25 is not adhered to the main fixed contact 27. That is, the main mobile contact 25 is separated from the main fixed contact 27, in accordance with the movement of the mobile frame 51. On the other hand, since the arc contact spring 24 is of a lift-off type, the arc contact units 3A and 3B are opened after the main contact units 2A and 2B, by allowing the main mobile contact 25 to be separated from the main fixed contact 27 and then allowing the end of the contact driving portion 53*b* to come in contact with the arc contact spring 24. In this condition, when the main contact units 2A and 2B are closed, the arc contact units 3A and 3B are first closed. That is, when the main contact units 2A and 2B, the arc contact units 3A and 3B are first closed and when the main contact units 2A and 2B are opened, the arc contact units 3A and 3B are opened later. In this way, since the opening and closing of the power supply path to a load is carried out by the arc contact units 3A and 3B, it is possible to prevent the adhesion due to arc. In addition, since the main contact units 2A and 2B connected in parallel to the arc contact units 3A and 3B are mainly supplied with current in electrical connection to the load, it is possible to suppress the loss due to increase in electrical resistance in the power supply path.

When large current flows in the main contact units 2A and 2B due to short-circuit of the power supply path to a load, the adhesion can occur due to arc at the time of opening the main contact units 2A and 2B. In the present embodiment, since the extension pieces 21*i* are provided to the main contact fixing pieces 21*f* of the fixed-side terminal plates 21A and 21B to be opposed to the main contact spring 23 and the attraction yoke 29 is fixed to the extension pieces 21*i*, a magnetic force acts so as to attract the main contact spring 23 to extension pieces 21*i* by allowing magnetic flux generated around the main contact spring 23 to pass through the attraction yoke 29. The magnetic force increases with increase the current passing through the main contact units 2A and 2B. Accordingly, when large current such as short-circuit current passes, a strong magnetic force acts to close the main contact units 2A and 2B, thereby preventing the main contact units 2A and 2B from being opened.

Figure 6:
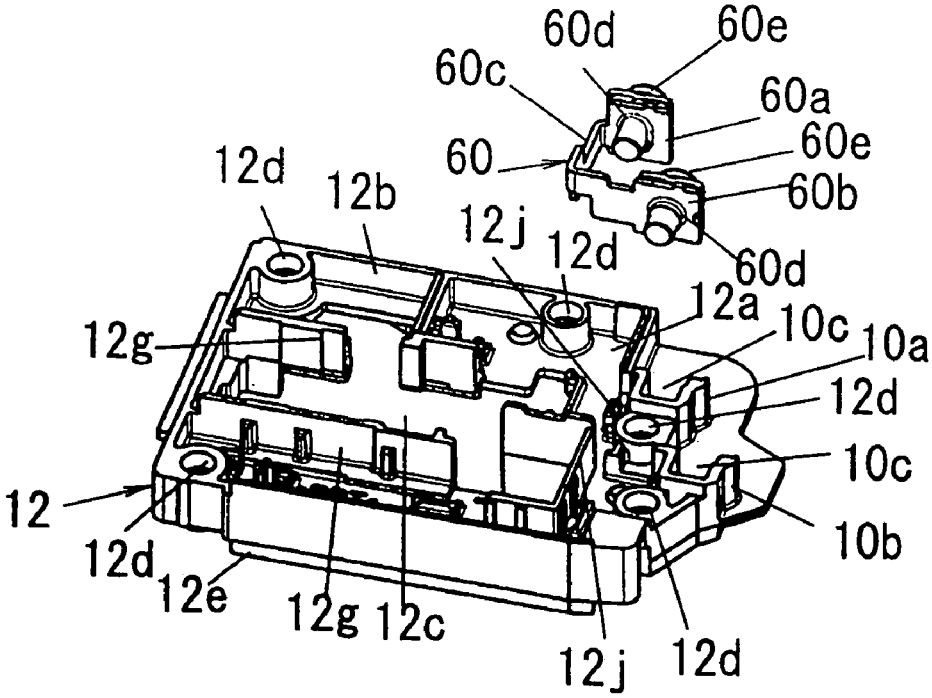
FIG. 6 is an exploded perspective view illustrating a main part of an electromagnetic relay according to another embodiment of the invention.

Although the above-mentioned embodiment has exemplified a double-cut type electromagnetic relay in which the main contact units 2A and 2B are inserted into two passages which are the power supply path to a load from a power source, respectively, a side-cut type electromagnetic relay in which the main contact unit 2A is inserted into only one of two passages which are the power supply path to a load from a power source may be employed. The side-cut electromagnetic relay can be embodied as shown in FIG. 6, by using a transfer terminal plate 60 instead of the fixed-side terminal plate 21B and the mobile-side terminal plate 22B as the member received in the intermediate body 12. The transfer terminal plate 60 includes terminal pieces 60*a* and 60*b* placed on the terminal bases 10*a* and 10*b*, respectively, disposed in the intermediate body 12 and has a shape that the terminal pieces 60*a* and 60*b* are connected to each other through a bridge piece 60*c*. Screw holes 60*d* are formed at the center of the respective terminal pieces 60*a* and 60*b* and a terminal screw 60*e* is coupled to the respective screw holes 60*d* fitted with a washer.

When the intermediate body 12 shown in FIG. 6 is employed, the electromagnet unit 5 drives one main contact unit 2A and one arc contact unit 3A. Accordingly, no element is disposed in the region for receiving the main contact unit 2B and the arc contact unit 3B in the intermediate body 12 and the intermediate body 12 is sued only for arranging the transfer terminal plate 60. However, since the same intermediate body 12 can be used for both of the double-cut type and the side-cut type, it is possible to suppress increase in element kinds by means of common use of elements while providing two kinds of electromagnet relays.

Figure 7:
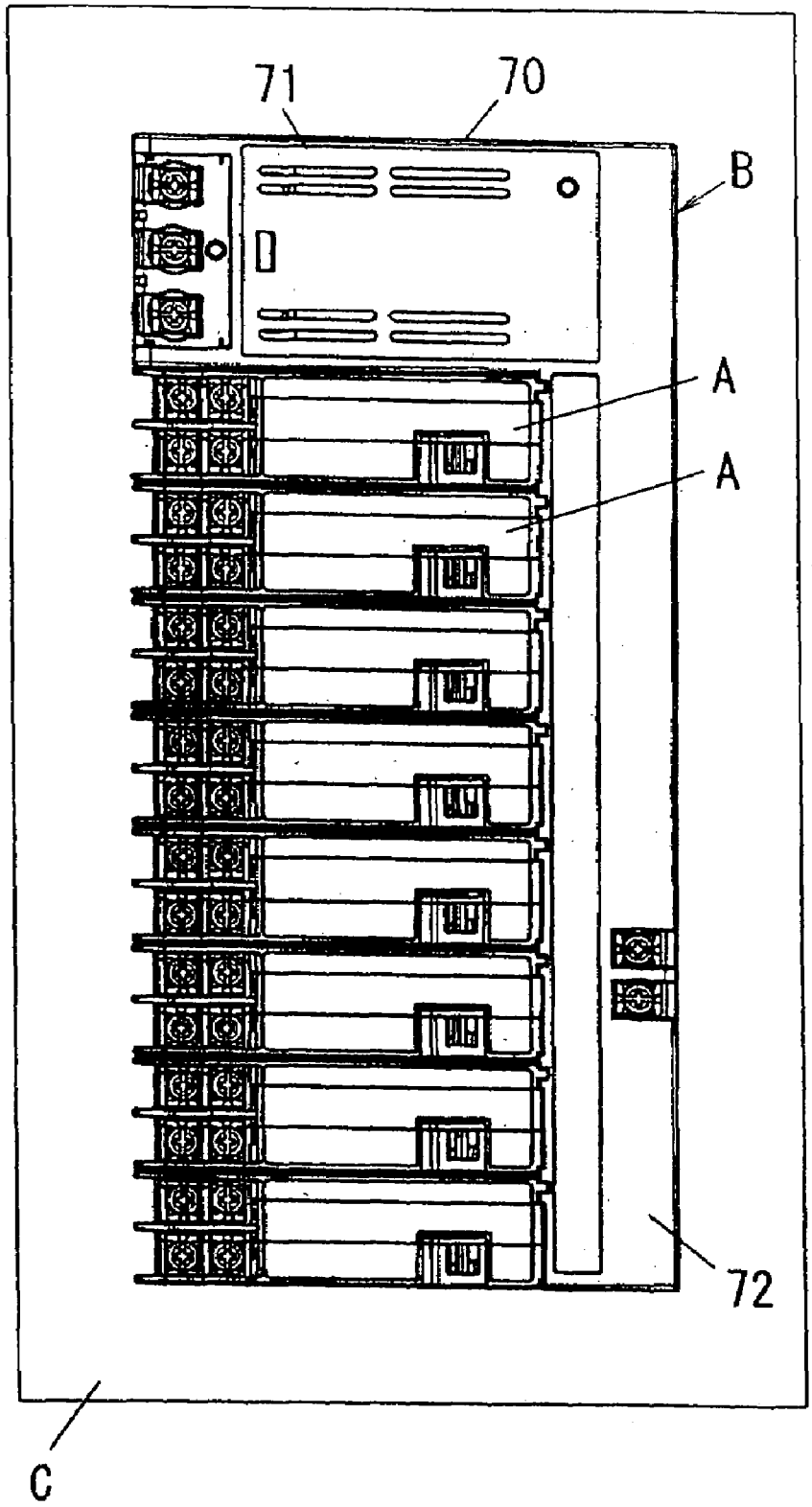
FIG. 7 is a front view illustrating a state in use of an electromagnetic relay in use according to an embodiment of the invention.
Figure 8:
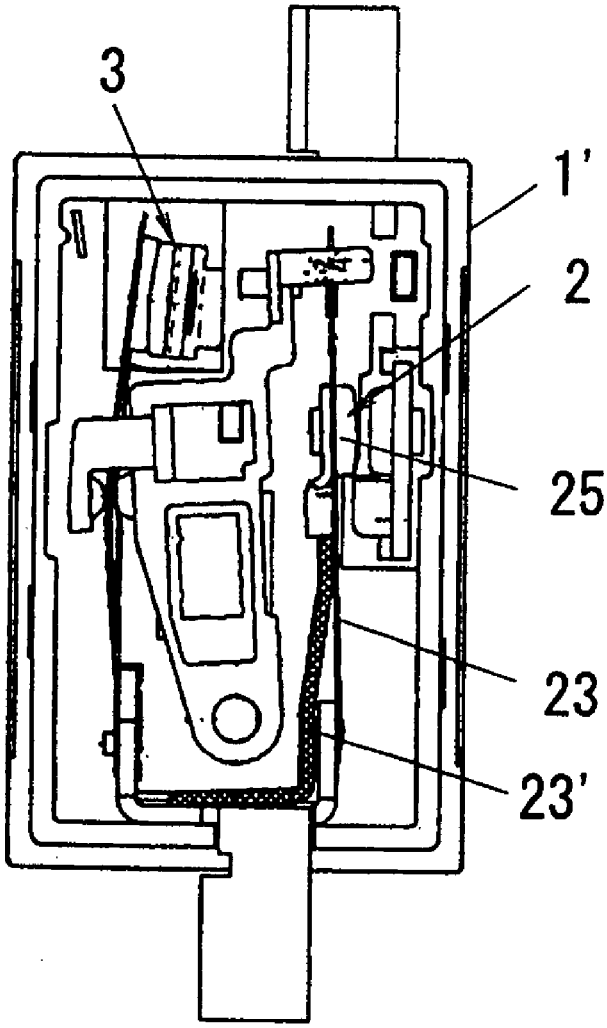
Prior Art FIG. 8
FIG. 8 is a cross-sectional view illustrating a conventional electromagnetic relay.

The above-mentioned electromagnetic relay A is fitted to a relay connector B for use, as shown in FIG. 7. The relay connector B is received in and fixed to a board C such as a control board. Since the relay connector B is not important to the invention, detailed description thereof is omitted. A frame body 70 of the relay connector B has an L shape, as seen in a front view, including a body section 71 having sizes (so-called switchboard agreement sizes) of internal instruments (such as breakers) for switchboard defined in Japanese Industrial Standard (JIS) and a relay holding section 72 protruding integrally from the side surface of the body section 71. In the figure, the size is set to fit eight electromagnetic relays A to the relay holding section 72 in maximum.

As can be apparent from the shapes of the terminal pieces 31*c*, 31*d*, and 32*c* in the electromagnetic relay A, the terminal pieces 31*c*, 31*d*, 32*c*, 44*c*, and 44*d* are of an insertion type. Connectors (not shown) provided with contact elements (not shown) for inserting the terminal pieces 31*c*, 31*d*, 32*c*, 44*c*, and 44*d* of the respective electromagnetic relays A are formed in the relay holding section 72 and the coupling box 10*d* is detachably fitted to the connectors. As shown in the figure, in the state that eight electromagnetic relay A are fitted to the relay holding section 72, the relay holding section 72 has a width (the vertical width in the figure) corresponding to ten unit sizes in the switchboard agreement size. In the switchboard agreement size, it can be fitted to the switchboard as the internal instruments of the switchboard, only if the horizontal sizes in the figure are equal and the vertical size is integer times as large as a unit size. Accordingly, by fitting the electromagnetic relays A to the relay connector B, the electromagnetic relays A and the relay connector B can be fitted to the board C by the use of members for fitting the internal instruments of the switchboard.

As shown in the figures, by disposing the body 11, the intermediate body 12, and the cover 13 to be vertically stacked, the main contact units 2A and 2B and the arc contact units 3A and 3B are horizontally arranged in each electromagnetic relay A. Accordingly, it is possible to prevent powder wastes with high resistance, which are generated at the time of opening and closing the arc contact units 3A and 3B, from dropping in the regions for receiving the arc contact units 3A and 3B and being attached to the main contact units 2A and 2B. As a result, the performance of the main contact units 2A and 2B can be maintained for a long period of time, thereby providing products having excellent durability.

In the configuration according to the invention, since the arc contact unit and the auxiliary contact unit among the main contact unit, the arc contact unit, and the auxiliary contact unit which are all received in the frame body are arranged adjacent to each other and the main contact spring of the main contact unit extends in the direction in which the arc contact unit and the auxiliary contact unit are arranged, it is possible to set the length of the arc contact spring relatively great in the frame body. That is, by enhancing the length of the main contact spring while increasing the sectional area of the main contact spring, it is possible to prevent the increase in spring constant. As a result, it is possible to secure the sectional area corresponding to the current capacity without using any braided wire in the main contact unit. In addition, since the braided wire is not required, it is possible to reduce the number of elements and the number of assembly steps, compared with the conventional configuration that the braided wire is used.

What is claimed is:

1. An electromagnetic relay comprising a main contact unit which is inserted into a power supply path to a load, an arc contact unit which is connected in parallel to the main contact unit, an auxiliary contact unit which is electrically independent of the main contact unit and the arc contact unit, an electromagnet unit which includes an armature block interlocking the main contact unit, the arc contact unit, and the auxiliary contact unit with each other, and a frame body which receives the main contact unit, the arc contact unit, the auxiliary contact unit, and the electromagnet unit, wherein the main contact unit includes a main fixed contact fixed to the frame body and a main contact spring made of a leaf spring and fitted with a main mobile contact which is attached to and detached from the main fixed contact, wherein the arc contact unit and the auxiliary contact unit are arranged adjacent to each other, and wherein the main contact spring extends in a direction in which the arc contact unit and the auxiliary contact unit are arranged.

2. The electromagnetic relay according to claim 1, wherein a partition wall which partitions the inside of the frame body into regions for receiving the main contact unit, the arc contact unit, and the auxiliary contact unit is provided in the frame body.

3. The electromagnetic relay according to claim 2, wherein a part of the partition wall surrounds a region for receiving the electromagnet unit and positions and fixes the electromagnet unit to the frame body by coming in contact with the electromagnet unit.

4. The electromagnetic relay according to claim 1, wherein the electromagnet unit includes a mobile frame made of an insulating material which is disposed between the main contact unit and the arc contact unit and which opens and closes the main contact unit and the arc contact unit by reciprocating around an axis pin disposed at a predetermined position, and wherein an extension, which extends in a direction in which an end of the mobile frame separated from the axis pin is connected to the axis pin and which covers the main contact spring from the arc contact unit, is formed in the end of the mobile frame.

5. The electromagnetic relay according to claim 1, wherein a plate-shaped terminal piece disposed in a coil terminal connected to a coil of the electromagnet unit and a plate-shaped terminal piece disposed in an auxiliary terminal plate of the auxiliary contact unit are protruded externally from the frame body.

6. The electromagnetic relay according to claim 1, wherein the frame body has a structure that a body, an intermediate body, and a cover arranged in a vertical direction are sequentially stacked, wherein the intermediate body has an opening into which the electromagnet unit disposed between the body and the cover is inserted, wherein a space for receiving a pair of the main contact unit and the arc contact unit connected in parallel to each other and a terminal base on which a terminal for connecting the main contact unit and the arc contact unit to the power supply path is disposed are formed between the body and the intermediate body, and wherein a space for receiving another pair of the main contact unit and the arc contact unit connected in parallel to each other and a terminal base on which a terminal for connecting the main contact unit and the arc contact unit to the power supply path and a terminal of a transfer terminal plate inserted into the power supply path are selectively disposed are formed between the intermediate body and the cover.

7. The electromagnetic relay according to claim 1, wherein an attraction yoke, which is made of a magnetic substance, which forms a magnetic flux path around the main contact spring, and which has a magnetic force in a direction in which the main mobile contact is brought into contact with the main fixed contact, is disposed in the frame body.

8. An electromagnetic relay comprising a main contact unit which is inserted into a power supply path to a load, an arc contact unit which is connected in parallel to the main contact unit, an auxiliary contact unit which is electrically independent of the main contact unit and the arc contact unit, an electromagnet unit which includes an armature block interlocking the main contact unit, the arc contact unit, and the auxiliary contact unit with each other, and a frame body which receives the main contact unit, the arc contact unit, the auxiliary contact unit, and the electromagnet unit, wherein the main contact unit includes a main fixed contact fixed to the frame body and a main contact spring made of a leaf spring and fitted with a main mobile contact which is attached to and detached from the main fixed contact, wherein the arc contact unit and the auxiliary contact unit are arranged adjacent to each other, wherein the main contact spring extends in a direction in which the arc contact unit and the auxiliary contact unit are arranged, wherein the electromagnet unit includes a mobile frame made of an insulating material which is disposed between the main contact unit and the arc contact unit and which opens and closes the main contact unit and the arc contact unit by reciprocating around an axis pin disposed at a predetermined position, wherein an extension, which extends in a direction in which an end of the mobile frame separated from the axis pin is connected to the axis pin and which covers the main contact spring from the arc contact unit, is formed in the end of the mobile frame, and wherein a plate-shaped terminal piece disposed in a coil terminal connected to a coil of the electromagnet unit and a plate-shaped terminal piece disposed in an auxiliary terminal plate of the auxiliary contact unit are protruded externally from the frame body.

9. An electromagnetic relay comprising a main contact unit which is inserted into a power supply path to a load, an arc contact unit which is connected in parallel to the main contact unit, an auxiliary contact unit which is electrically independent of the main contact unit and the arc contact unit, an electromagnet unit which includes an armature block interlocking the main contact unit, the arc contact unit, and the auxiliary contact unit with each other, and a frame body which receives the main contact unit, the arc contact unit, the auxiliary contact unit, and the electromagnet unit, wherein the main contact unit includes a main fixed contact fixed to the frame body and a main contact spring made of a leaf spring and fitted with a main mobile contact which is attached to and detached from the main fixed contact, wherein the arc contact unit and the auxiliary contact unit are arranged adjacent to each other, wherein the main contact spring extends in a direction in which the arc contact unit and the auxiliary contact unit are arranged, wherein the frame body has a structure that a body, an intermediate body, and a cover arranged in a vertical direction are sequentially stacked, wherein the intermediate body has an opening into which the electromagnet unit disposed between the body and the cover is inserted, wherein a space for receiving a pair of the main contact unit and the arc contact unit connected in parallel to each other and a terminal base on which a terminal for connecting the main contact unit and the arc contact unit to the power supply path is disposed are formed between the body and the intermediate body, wherein a space for receiving another pair of the main contact unit and the arc contact unit connected in parallel to each other and a terminal base on which a terminal for connecting the main contact unit and the arc contact unit to the power supply path and a terminal of a transfer terminal plate inserted into the power supply path are selectively disposed are formed between the intermediate body and the cover, and wherein an attraction yoke, which is made of a magnetic substance, which forms a magnetic flux path around the main contact spring, and which has a magnetic force in a direction in which the main mobile contact is brought into contact with the main fixed contact, is disposed in the frame body.

* * * * *